United States Patent [19]

Arimoto

[11] Patent Number: 4,882,521

[45] Date of Patent: Nov. 21, 1989

[54] DEFLECTION YOKE FOR A COLOR CATHODE RAY TUBE

[75] Inventor: Nozomu Arimoto, Takatsuki, Japan

[73] Assignee: Matsushita Electronics Corporation, Kadoma, Japan

[21] Appl. No.: 195,245

[22] Filed: May 18, 1988

[30] Foreign Application Priority Data

May 19, 1987 [JP] Japan ..... 62-121956

[51] Int. Cl.[4] ..... H01J 29/70

[52] U.S. Cl. ..... 313/440; 358/248; 335/213

[58] Field of Search ..... 313/440, 442, 431; 358/248, 249; 335/213

[56] References Cited

U.S. PATENT DOCUMENTS 4,257,024 3/1981 Shimoma et al. ..... 335/213

4,785,272 11/1988 Osseyran ..... 335/213

FOREIGN PATENT DOCUMENTS 60-1732 1/1985 Japan .

*Primary Examiner*—Donald J. Yusko

*Assistant Examiner*—Sandra L. O'Shea

*Attorney, Agent, or Firm*—Cushman, Darby & Cushman

[57] ABSTRACT

A deflection yoke has magentic field correcting auxiliary yokes (5) disposed at the flare side end of the insulative bobbin (2) for holding a pair of horizontal deflection coils (3) and a pair of vertical deflection coils (4), each magnetic field correcting auxiliary yokes (5) comprising a long and slender arc shaped core (6) disposed along the end portion of either of the horizontal deflection coils (4) or the vertical deflection coils (4) and a pair of auxiliary coils (8R, 8L) which are wound on the core (6) and connected in series to the vertical deflection coils (4); and thereby the raster distortion and misconvergence are substantially reduced.

18 Claims, 7 Drawing Sheets

DEFLECTION YOKE FOR A COLOR CATHODE RAY TUBE

FIELD OF THE INVENTION AND RELATED ART STATEMENT

1. Field of the Invention

The present invention relates to a deflection yoke for a color cathode ray tube wherein auxiliary coils for correcting deflection magnetic field distribution are disposed in the vicinity of flare ends of either pair of horizontal deflection coils and vertical deflection coils.

2. Description of the Relates Art

It has been widely practiced that each distribution of a horizontal deflection magnetic field and a vertical deflection magnetic field for electron beams of an in-line type color cathode ray tube are made non-uniform to make a so-called self-convergence. The non-uniform magnetic fields are for attaining the self-convergence system which dispenses with a convergence circuit. However, it is difficult to perfectly converge the three electron beams at all points on a phosphor screen, without mis-convergence. Also, in such system the raster shape is not rectangular, but distorted slightly in a pin-cushion shape or a barrel shape, and therefore addition of a circuit for correcting such distortion is required.

In order to solve the above problem, a proposal has been made to reduce both the pin-cushion distortion of raster and mis-convergence by providing an auxiliary coil having a core and conducting a vertical deflection current therein, as disclosed in the Japan Patent Kokai Sho 60-1732.

There is another problem that, when the yoke is made small-sized and disposed close to the electron guns to enhance reflection efficiency and lower power consumption, raster makes distortions to barrel shape at its upper and lower edges and pin-cushion shape at the right and left edges, as shown in FIG. 5. And, as shown in FIG. 6, rasters formed by side electron beams (B designates an electron beam for blue light emission and R designates an electron beam for red light emission) cross each other; and thereby a mis-convergence due to negative trilemma take place. Such raster distortion and mis-convergence cannot be eliminated by mere adjustment of the distribution of magnetic field by adjusting the main deflection coils.

In the present invention, such a problem is solved by providing: a pair of small auxiliary coils wound onto a ribbon-shaped or wire-shaped core in the vicinity of the flare ends of either pair of the horizontal deflection coils and the vertical deflection coils, which are attached to a funnel-shaped insulating bobbin, and connection these auxiliary coils in series to the rest of the above-mentioned deflection coils.

By such a configuration, a magnetic field produced by the auxiliary coils can weakly deflect the electron beams outward at the mid portion of the raster on the upper and lower edges and at the same time can strongly deflect them outward at the end portions thereof. Thereby, the barrel-shaped distortion of the raster can be reduced. Also, in the corner area of the raster, the electron beams deviating outside can be weakly deflected outward, and the electron beams deviating inside can be deflected outward more strongly. Thereby, the misconvergence can be reduced.

As described above, in accordance with the present invention, a yoke can be made small-sized and highly efficient in deflection while attaining corrections of both of raster distortion and mis-convergence by addition of simple auxiliary coils.

While the novel features of the invention are set forth particularly in the appended claims, the invention, both as to organization and content, will be better understood and appreciated, along with other objects and features thereof, from the following detailed description taken in conjunction with the drawings.

DESCRIPTION OF THE PREFERRED EMBODIMENT

Figure 1:
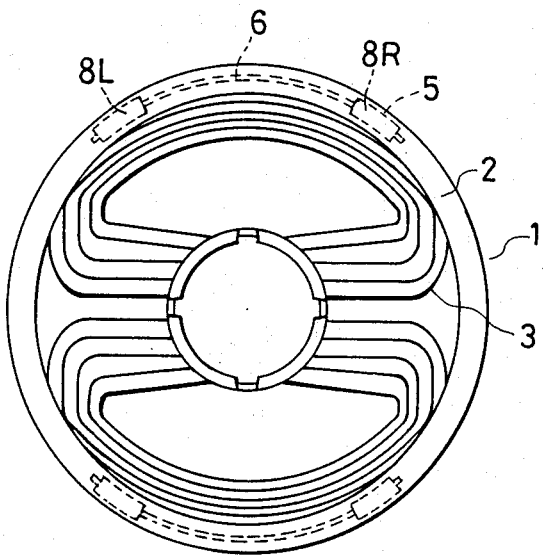
FIG. 1, FIG. 2, FIG. 2A and FIG. 2B are a front view, a side view and front view and a perspective view with cover removed of a deflection yoke embodying the present invention, respectively.
Figure 2:
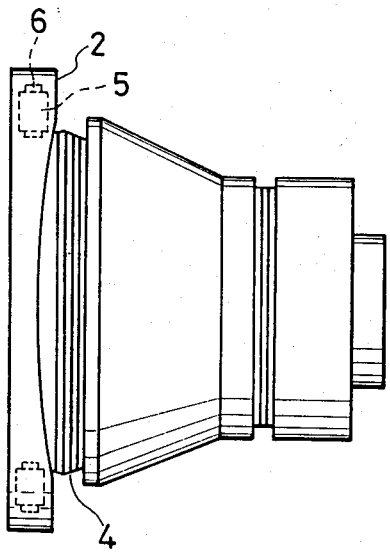
Figure 2A:
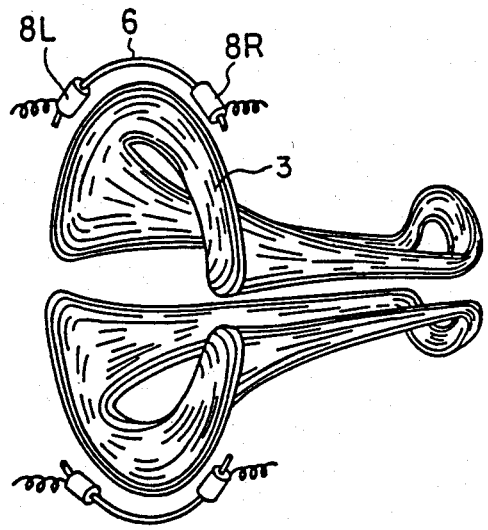

In FIG. 1, FIG. 2 and FIG. 2A which are a front view, a side view and a perspective view with cover removed of a deflection yoke embodying the present invention, respectively, horizontal deflection coils 3 and vertical deflection coils 4 are mounted on a funnel-shaped insulating bobbin 2 constituting a deflection yoke 1. Both of the deflection coils 3 and 4 are of a saddle winding type. In this saddle winding type deflection coils, the magnetic field distribution in the axial direction is concentrated more effectively in comparison with that of the troidal winding, and the gap between an electron gun and the coils can be made smaller. Thereby the deflection efficiency can be enhanced and the yoke itself can be constituted in a small size.

Figure 3:
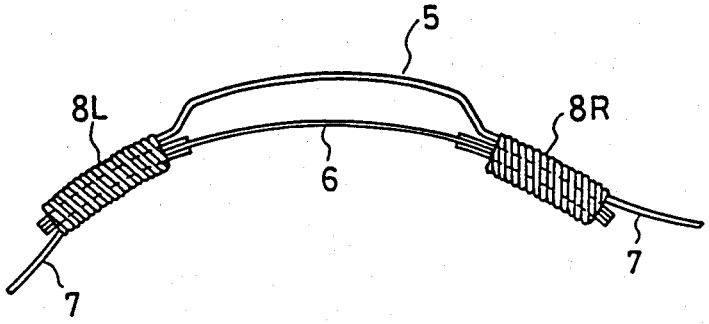
FIG. 3 is a side view of auxiliary coils of the same deflection yoke.

Auxiliary coils 5 are provided close to the flare ends of the horizontal deflection coils 3, namely, the bent portions facing a phosphor screen. As exemplified in FIG. 3, this auxiliary coil 5 is formed by winding an insulated copper wire 7 onto a ribbon-shaped core 6. When a current flows through a left-side coil 8L and a right-side coil 8R formed near the left and right ends of the core 6, small magnetic fields of the same polarity are produced. The portion of the core where the left-side and right-side coils 8L and 8R are located is made thicker in comparison with the mid portion of the core to reduce the magnetic resistance.

The core 6 is made of ferro-magnetic material for core, for example, a silicon steel band of 0.35 mm thickness and 5.0 mm width, and the thick parts at both ends are constituted by laminating three silicon steel bands to make 1.05 mm–1.5 mm thickness. The dimensions are selected appropriately in accordance with a required intensity and distributing of the auxiliary magnetic field.

Figure 4A:
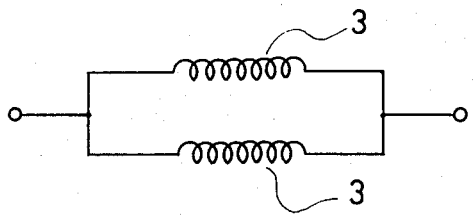
FIG. 4a and 4b are connection diagrams of the same deflection yoke.
Figure 4B:
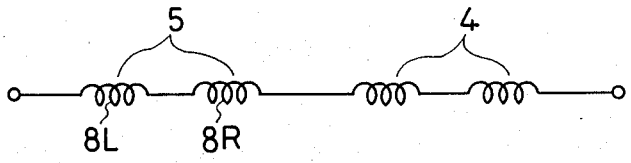

FIG. 4(a) and FIG. 4(b) are connection diagrams of the horizontal deflection coils 3, the vertical deflection coils 4 and the auxiliary coils 5. The auxiliary coils 5 are connected in series to the vertical deflection coils 4.

Figure 5:
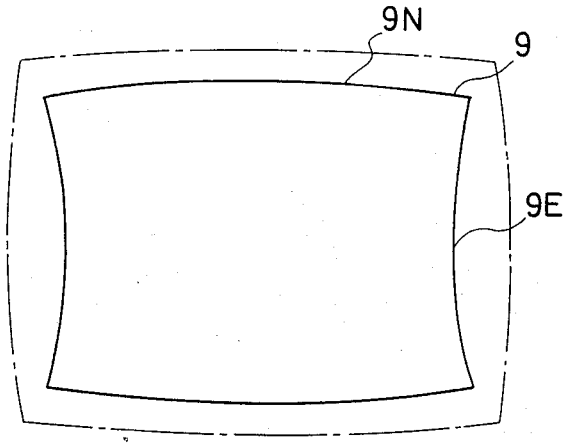
FIG. 5 and FIG. 6 are views exemplifying patterns of raster distortion and mis-convergence to be solved by the present invention.

FIG. 5 exemplified a shape of raster having distortion, wherein a nearly rectangular raster 9 is distorted in a barrel shape on the upper and lower edges 9N and in a pin-cushion shape on the left and right edges 9E.

Figure 6:
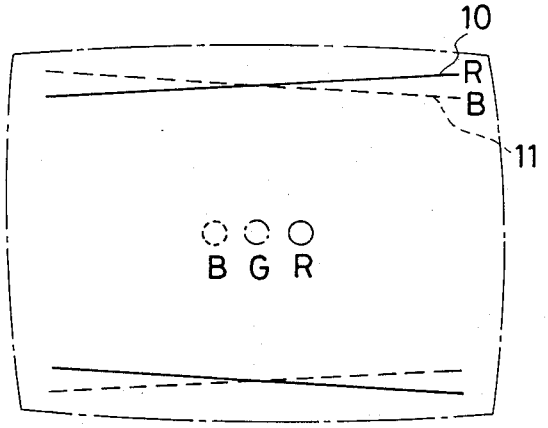

FIG. 6 exemplifies a pattern of mis-convergence, wherein the blue electron beam B located in the left side is deflected smaller at the right top portion of the screen, while the red electron beam R located in the right-side is deflected larger, at the right top portion of the screen. Thus both rasters 10 and 11 for red color and blue color cross each other as illustrated, thus producing the mis-convergence called negative trilemma. It has been impossible to simultaneously eliminate the raster distortion as shown in FIG. 5 and the misconvergence as shown in FIG. 6 only by adjusting the distribution of the magnetic field of the conventional deflection coils. However, in accordance with the present invention, these problems can be dissolved only by adding simple auxiliary coils. Hereinafter, description is made on the operation and function thereof.

Figure 7:
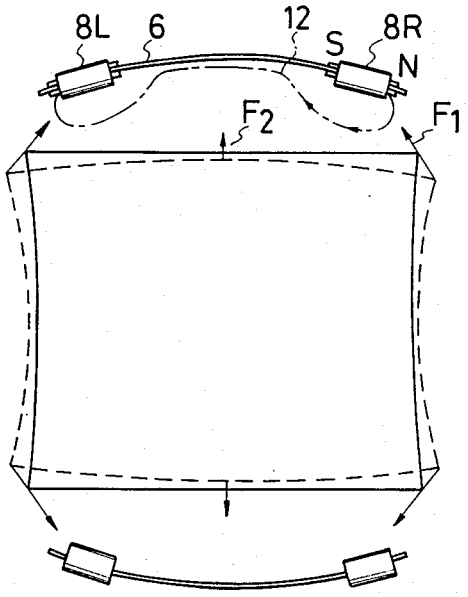
FIG. 7 is a view for explaining operation of correcting raster distortion.

FIG. 7 is an explanatory view of correcting operation of the raster distortion as shown in FIG. 6, and for the sake of convenience and simplicity, the explanation is made only on the right top part of the screen, since these of other parts are quite similar to the right top part. When the vertical deflection current flows through the right-side coil 8R disposed in the vicinity of region wherein electron beam trajectories corresponding to the right top of the screen pass, the magnetic field produced by the right side coil 8R loosely couple with the magnetic field produced by the left-side coil 8L in the same polarity. And a line of magnetic force 12 curves outside at the mid portion. As a result, a large magnetic force $F_1$ in the upward and inward direction acts on the electron beam at the right top portion, while a small magnetic force $F_2$ in the upward direction acts at the mid portion. Consequently, barrelshape (convex) distorted upper and lower edges of the raster are corrected into substantially straight lines; and the pin-cushion shape (concave) distorted left and right edges are corrected also into substantially straight lines. The magnitudes and directions of the magnetic forces $F_1$ and $F_2$ can be set to desired values by adequately setting the number of turns on the set position of the auxiliary coils or the distribution of the magnetic resistance of the core. When the pin-cushion distortions of the left and right edges are small, the magnetic force $F_1$ may be made to act only in the upward direction.

Figure 8:
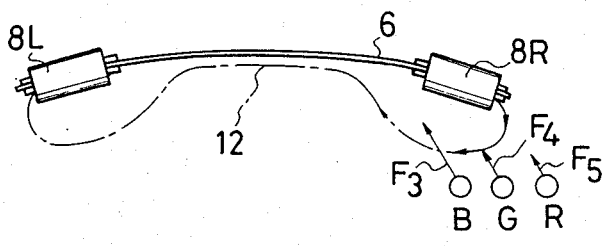
FIG. 8(*b*) is a raster of the blue electron beam.
Figure 8B:
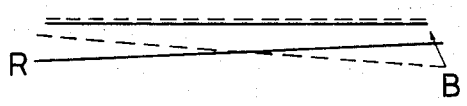
FIG. 8*a* is a view for explaining operation of correcting mis-convergence.

FIG. 8(*a*) is an explanatory view of an action of correcting the mis-convergence as shown in FIG. 6. As shown in FIG. 8(*a*), the largest magnetic force $F_3$ acts on a blue electron beam B located in the left side, and the smallest magnetic force $F_5$ acts on a red electron beam R located at right-side. Therefore, as shown in FIG. 8(*b*), the raster of the blue electron beam B located inside the ideal position in the right top part is corrected largely upward at the right top corner of the screen. Thereby, the raster of the left-side located blue electron beam B can be made nearly register with the raster of the right-side located electron beam R; and thus the mis-convergence can be suppressed to a very small extent.

Figure 2B:
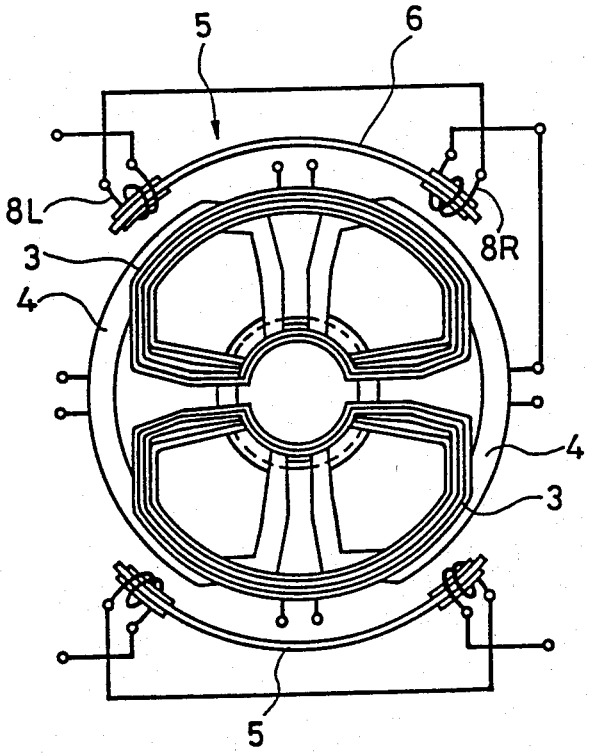

The above description is made on an example of configuration and action thereof in the case where the auxiliary coils are disposed at the outside close to the flare ends of the horizontal deflection coils; but they can be disposed at other positions corresponding to the raster shape to be corrected. The core 12 of the auxiliary coil may be of a rod or wire of ferromagnetic material, and further, the auxiliary coils may be installed in the vicinity of the flare ends of the vertical deflection coils and still further they may be connected in series to the horizontal deflection coils as shown in FIG. 2B. Further, the auxiliary coils may be connected in parallel to the vertical or horizontal deflection coils.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. A deflection yoke for a color cathode ray tube comprising:
   - a pair of horizontal deflection coils;
   - a pair of vertical deflection coils;
   - an insulative bobbin for supporting said deflection coils, said bobbin having a flared end;
   - magnetic field correction means disposed at the flared end of the insulative bobbin, having ferro-magnetic cores of a long and slender shape and disposed along the end portion of either of said horizontal deflection coils or said vertical deflection coils; and
   - a pair of auxiliary coils which are wound at both end portions of said core and are connected to said horizontal or vertical deflection coils, respectively.

2. A deflection yoke in accordance with claim 1, wherein said auxiliary coils are connected in series to said horizontal and vertical deflection coils.

3. A deflection yoke for a color cathode ray tube comprising:
   - a pair of horizontal deflection coils;
   - a pair of vertical deflection coils;
   - an insulative bobbin for supporting said deflection coils, said bobbin having a flared end; and
   - magnetic field correction means disposed at the flared end of the insulative bobbin, having ferro-magnetic cores of a long and slender shape and disposed along the end portion of either of said horizontal deflection coils or said vertical deflection coils; and
   - a pair of auxiliary coils which are wound on said core and are connected in series to said horizontal or vertical deflection coils, respectively.

4. A deflection yoke in accordance with claim 1, wherein both end portions of said core are formed thicker in comparison to the mid portion thereof.

5. A deflection yoke in accordance with claim 3 wherein both end portions of said core are formed thicken in comparison to the mid portion thereof.

6. A deflection yoke for a color cathode ray tube comprising:
   - a pair of horizontal deflection coils;
   - a pair of vertical deflection coils;
   - an insulative bobbin for supporting said deflection coils, said bobbin having a flared end; and
   - magnetic field correction means disposed at the flared end of the insulative bobbin, having ferro-magnetic cores of a long and slender shape and disposed along the end portion of either of said horizontal deflection coils or said vertical deflection coils, both end portions of said core are formed thicker in comparison with the mid portion thereof; and
   - a pair of auxiliary coils which are wound on said core and are connected to said horizontal or vertical deflection coils, respectively.

7. A deflection yoke in accordance with claim 1, wherein both of said horizontal deflection coils and said vertical deflection coil are of saddle winding type.

8. A deflection yoke in accordance with claim 3 wherein both of said horizontal deflection coils and said vertical deflection coil are of saddle winding type.

9. A deflection yoke in accordance with claim 6 wherein both of said horizontal deflection coils and said vertical deflection coil are of saddle winding type.

10. A deflection yoke in accordance with claim 1, wherein said core is curved in a convex arc shape along the end portion of the deflection coil.

11. A deflection yoke in accordance with claim 3 wherein said core is curved in a convex arc shape along the end portion of the deflection coil.

12. A deflection yoke in accordance with claim 6 wherein said core is curved in a convex arc shape along the end portion of the deflection coil.

13. A deflection yoke in accordance with claim 1, wherein said ferro-magnetic core is of a ribbon shape or a wire shape.

14. A deflection yoke in accordance with claim 3 wherein said ferro-magnetic core is of a ribbon shaape or a wire shape.

15. A deflection yoke in accordance with claim 6 wherein said ferro-magnetic core is of a ribbon shape or a wire shape.

16. A deflection yoke in accordance with claim 1 wherein said ferro-magnetic cores are disposed along said horizontal deflection coils.

17. A detection yoke in accordance with claim 3 wherein said ferro-magnetic cores are disposed along said horizontal deflection coils.

18. A deflection yoke in accordance with claims 6 wherein said ferro-magnetic cores are disposed along said horizontal deflection coils.

* * * * *